United States Patent [19]

Haug

[11] 4,147,138

[45] Apr. 3, 1979

[54] MUSHROOM-TYPE VALVE COOLED BY COOLING FLUID CIRCULATION

[75] Inventor: Albert Haug, Montmorency, France

[73] Assignee: Societe d'Etudes de Machines Thermiques, Saint-Denis, France

[21] Appl. No.: 718,762

[22] Filed: Aug. 30, 1976

[30] Foreign Application Priority Data

Oct. 30, 1975 [FR] France ..... 75 33197

[51] Int. Cl.[2] ..... F01P 3/14

[52] U.S. Cl. ..... 123/41.41; 123/188 AA

[58] Field of Search ..... 123/41.41, 41.34, 188 GC, 123/188 A, 188 AA

[56] References Cited

U.S. PATENT DOCUMENTS

| | | | |
|---|---|---|---|
| 1,255,469 | 2/1918 | Schlieder | 123/188 A |
| 1,345,548 | 7/1920 | Montague | 123/188 AA |
| 1,361,214 | 12/1920 | Wild | 123/188 AA |
| 1,448,873 | 3/1923 | Searles | 123/188 AA |
| 1,470,041 | 10/1923 | Wilcox | 123/188 AA |
| 1,767,409 | 6/1930 | Spire et al. | 123/188 AA |
| 2,377,459 | 6/1945 | Strauss | 123/41.41 |
| 2,410,190 | 10/1946 | Townhill | 123/188 AA |
| 2,439,240 | 4/1948 | Cummings | 123/188 AA |
| 3,313,277 | 4/1967 | Adolfsson et al. | 123/41.41 |
| 3,871,339 | 3/1975 | Kuhn | 123/41.41 |
| 3,945,356 | 3/1976 | Kuhn | 123/41.41 |

FOREIGN PATENT DOCUMENTS

| | | | |
|---|---|---|---|
| 726320 | 8/1942 | Fed. Rep. of Germany | 123/188 AA |
| 2361712 | 6/1975 | Fed. Rep. of Germany | 123/188 GC |

*Primary Examiner*—Sheldon J. Richter
*Attorney, Agent, or Firm*—Jay L. Chaskin

[57] ABSTRACT

The invention relates to a mushroom-type valve cooled by cooling fluid circulation for an internal combustion engine wherein the terminal face of the end portion of the stem is aligned flush with the corresponding face of the valve head and forms the central portion thereof, and the assembling of the head is carried out by brazing on the stem along the whole of their interface.

19 Claims, 2 Drawing Figures

MUSHROOM-TYPE VALVE COOLED BY COOLING FLUID CIRCULATION

The present invention relates to a machine valve, more particularly a mushroom-type valve cooled by cooling fluid circulation for an internal combustion engine.

Valves of this type are commonly constituted by a stem and a head assembled thereto, the said assembly being performed by screwing by means of a threaded surface provided on the periphery of the stem in proximity to one of its ends, and a threaded axial bore provided in the head. Slight interstices, however, usually remain between the threads, so that a brazing is performed to fill up the said interstices and ensure a better locking of the head on the stem. It is indeed highly important to ensure a good rigidity of the head-and-stem assembly of the valve, resulting more particularly in preventing cooling fluid leakage through the joint therebetween.

Moreover, a perfect bearing of the valve head upon its seat must be ensured, and this, in mushroom-type valves cooled by cooling fluid circulation, gives rise to problems due to the fact that the head is partially hollow to define a cavity in which the cooling fluid circulates, a structure which is apt to be deformed more rapidly under the action of high temperatures as compared with a plain-head structure.

The invention relates to a novel valve structure, more particularly at the head thereof, allowing both a better joint interface between the head and the stem and a better impact bearing of the valve upon its seat.

The invention therefore provides a valve, in particular for an internal combustion engine, of the mushroom-type cooled by cooling fluid circulation and composed of a stem and an annular head forming two members assembled to one another, the said head being entirely traversed by the corresponding end portion of the said stem, characterized in that the end face of the end portion of the said stem is flush and aligned with the corresponding face of the valve head and forms the central portion of the latter.

According to another feature of the invention, the head and stem are assembled to one another by screwing over a portion of the joint interface and by brazing over the whole joint interface.

According to an other feature of the invention, the head and the stem are assembled only by brazing.

Figure 2:
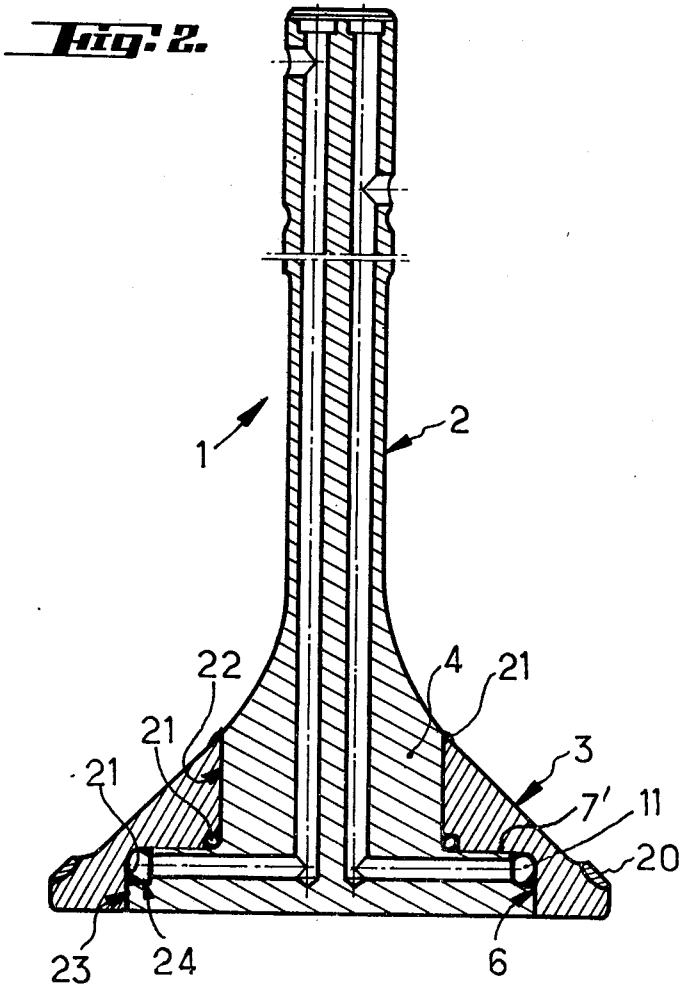
Figure 1:
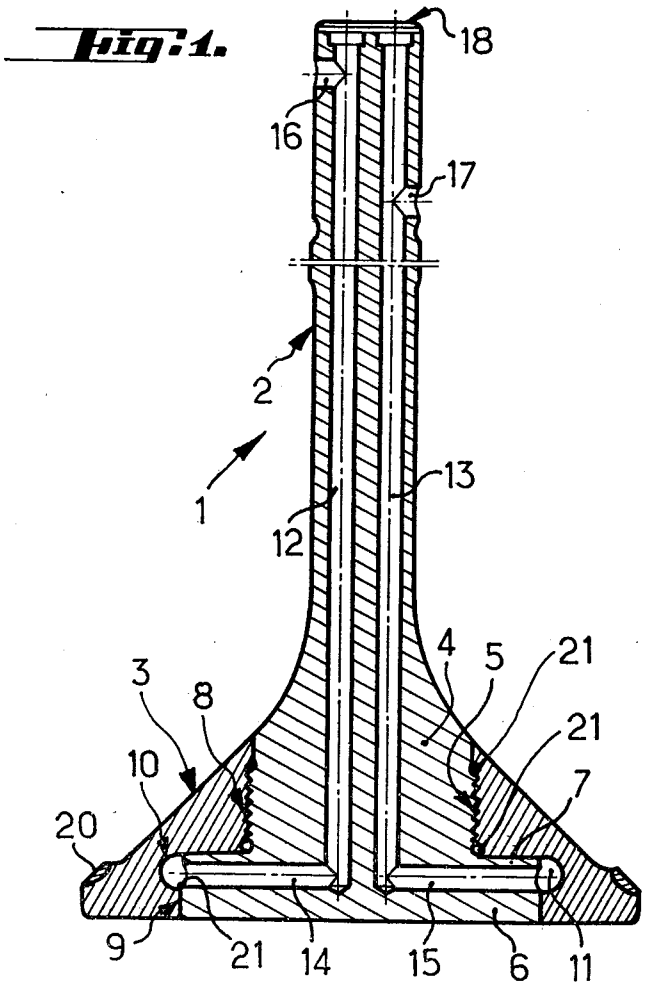

Other features and details of the invention will appear more clearly from the following explanatory description made with reference to the appended drawings given solely by way of example and wherein:

FIG. 1 is a longitudinal sectional view of a valve according to the invention, wherein the assembly is obtained by screwing and brazing according to a first form of embodiment, FIG. 2 is a longitudinal sectional view of a valve according to the invention, wherein the assembly is obtained solely by brazing according to a second form of embodiment.

Referring to FIG. 1, the valve 1 according to the invention comprises a stem 2 and an annular head 3 secured to the end of the stem 2. The valve stem 2 comprises towards its end intended to be assembled to the head 3 a cylindrical portion 4 provided with an external thread 5 and ends with a cylindrical portion 6 greater in diameter and defining a shoulder 7 between the said cylindrical portions.

The valve head 3 is frusto-conical in shape and comprises a tapped hole 8 ending with a bore 9 greater in diameter. A recess or counterbore 10 is provided on the internal wall of the bore 9 in prolongation of the shoulder 7 of the stem 2 so as to define, after the stem 2 and the head 3 are assembled together, an annular cooling chamber 11. The cooling chamber 11 communicates with two longitudinal conduits 12 and 13 of the stem 2 of the valve 1 through the medium of two transverse conduits 14 and 15, respectively. The longitudinal conduits 12 and 13 communicate respectively with two radial, outwardly opening inlet and outlet ports 16, 17 for the cooling fluid. The longitudinal channels 12 and 13 are closed by a member 18 secured by welding on the end of the stem 2 opposite the head 3 of the valve 1, the said member being associated with the rocker-arm (not shown) of the valve 1.

The head 3 of the valve 1 is provided with an annular sealing surface 20 which in the closed position of the valve rests on a seat (not shown) provided in the cylinder head.

The stem 2 is assembled to the head 3, on the one hand, by screwing the tapped hole 8 of the head on the cylindrical portion 4 of the stem 2 provided with the external thread 5, and, on the other hand, by brazing or hard-soldering over the whole joint interface so as to ensure a reliable fastening of the stem 2 to the head 3, i.e., around both the cylindrical portion 4 and the cylindrical portion 6 of the stem 2. When the assembling is completed, the end surface of the cylindrical portion 6 of the stem 2 forming the terminal face of the end portion of the said stem is flush and aligned with the corresponding face of the valve head 3 and forms the central portion of the latter.

The brazing or hard-soldering is carried out in a manner known per se through the medium of brazing rings 21 which are heated after being mounted.

Referring to FIG. 2, there is shown a valve 1 which differs from the one shown in FIG. 1 by the fact that the assembling is performed only by brazing or hard-soldering. In this case, the cylindrical portion 4 of the valve stem 2 is not provided with an external thread 5, and two bores 22 and 23 of different diameters are simply machined in the head 3 to define a shoulder 7' identical with the shoulder 7 of the valve shown in FIG. 1.

In addition, an annular chamber 11 is defined by an annular setback 24 machined on the internal surface of the cylindrical end-portion 6 of the stem 2 and by a corresponding portion of the shoulder 7' after the head 3 is secured to the stem 2.

Since the assembling is made only by brazing, it is important to note that the interfaces between the head and the stem may have any shape, preferably the one that is easiest to obtain.

Such a valve (FIG. 1 or 2) offers the considerable advantage that the stem 2 and the head 3 are in continuous contact over practically their whole interface, thus ensuring a perfectly rigid junction leading to a very good impact bearing of the valve upon its seat. In addition, the shoulders 7 and 7' ensure a good positioning and a good bearing of the head 3 upon the stem 2. As disclosed in the drawing the longitudinal and transverse and annular conduits have a uniform free cross-sectional area which is everywhere the same throughout the valve stem and head.

Of course the invention is by no means limited to the form of embodiment described and illustrated, which has been given by way of example only. In particular, it comprises all the means constituting technical equivalents to the means described as well as their combinations, should the latter be carried out according to the spirit of the invention.

What is claimed is:

1. A mushroom-type valve for an internal combustion engine comprising an assembled stem and annular head joined together along a common interface therebetween, the valve having a plurality of non-concentric fluid circulation conduits interconnected together by an annular passage formed in the annular head, said conduits and said annular passage being of uniform free cross-sectional area.

2. A valve according to claim 1 wherein the head coaxially surrounds an end portion of the stem, the end portion extending through the head to a terminal face of the head, the head having a cylindrical bore of a given diameter in complementary engagement with the end portion of the stem, the head having a cylindrical counter-bore of a diameter greater than the given diameter, the counter-bore being in complementary engagement with the end portion of the stem and the head terminal face being in aligned flush contacting relationship with a corresponding terminal face of the stem.

3. A valve according to claim 2 wherein the cylindrical bore of the head is engaged to the end portion of the stem by threaded means and by brazing or hard-soldering along the interface of the head and the stem.

4. A valve according to claim 2 wherein the cylindrical bore of the head is engaged to the end portion of the stem by brazing or hard-soldering along the interface of the head and the stem.

5. A valve according to claim 2 wherein the external surface of the head adjacent to the terminal face includes an annular sealing surface.

6. A valve according to claim 1 wherein the conduits comprise a plurality of passages extending substantially longitudinally and parallel within the stem.

7. A valve according to claim 6 wherein one of the longitudinal passages has an inlet port extending radially through the stem and further one of the longitudinal passages has an outlet port extending radially through the stem.

8. A valve according to claim 6 wherein the longitudinal passages extend to an opposite end of the stem from the end portion, and means for closing the passages at the opposite end.

9. A valve according to claim 1 wherein the conduits comprise a plurality of passages extending longitudinally within the stem, each longitudinal passage terminating in a passage transverse to the longitudinal passages, the transverse passages interconnected by an annular passage.

10. A valve according to claim 1 wherein the annular passage is formed at the complementary engagement interface between the counter-bore and the end portion of the stem.

11. A mushroom-type valve for an internal combustion engine comprising an assembled stem and annular head, the valve having a plurality of non-concentric fluid circulation conduits, the head coaxially surrounding an end portion of the stem, the end portion extending through the head to a terminal face of the head, the head having a cylindrical bore of a given diameter in complementary engagement with the end portion of the stem, the head having a cylindrical counter-bore of a diameter greater than the given diameter, the counter-bore being in complementary engagement with the end portion of the stem and the head terminal face being in aligned flush contacting relationship with a corresponding terminal face of the stem, with the conduits comprising a plurality of passages extending longitudinally within the stem, each longitudinal passage terminating in a passage transverse to the longitudinal passages, the transverse passages being interconnected by an annular passage, said longitudinal, transverse and annular passages being of uniform free-cross sectional area.

12. A valve according to claim 11 wherein the longitudinal passages extend substantially parallel within the stem.

13. A valve according to claim 4 wherein the cylindrical bore of the head is engaged to the end portion of the stem by threaded means and by brazing or hard-soldering along the interface of the head and the stem.

14. A valve according to claim 11 wherein the cylindrical bore of the head is engaged to the end portion of the stem by brazing or hard-soldering along the interface of the head and the stem.

15. A valve according to claim 11 wherein one of the longitudinal passages has an inlet port extending radially through the stem and further one of the longitudinal passages has an outlet port extending radially through the stem.

16. A valve according to claim 11 wherein the longitudinal passages extend to an opposite end of the stem from the end portion, and means for closing the passages at the opposite end.

17. A valve according to claim 11 wherein the annular passage is formed in the annular head.

18. A valve according to claim 17 wherein the annular passage is formed at the complementary engagement interface between the counter-bore and the end portion of the stem.

19. A valve according to claim 11 wherein the external surface of the head adjacent to the terminal face includes an annular sealing surface.

* * * * *